US012111126B2

(12) United States Patent
McNamee

(10) Patent No.: US 12,111,126 B2
(45) Date of Patent: Oct. 8, 2024

(54) STRAIGHT PULL TRIGGER

(71) Applicant: Daniel Defense, LLC, Black Creek, GA (US)

(72) Inventor: Amelia Laura McNamee, Statesboro, GA (US)

(73) Assignee: Daniel Defense, LLC, Black Creek, GA (US)

( * ) Notice: Subject to any disclaimer, the term of this patent is extended or adjusted under 35 U.S.C. 154(b) by 0 days.

(21) Appl. No.: 18/159,711

(22) Filed: Jan. 26, 2023

(65) Prior Publication Data

US 2023/0243612 A1 Aug. 3, 2023

Related U.S. Application Data

(60) Provisional application No. 63/304,263, filed on Jan. 28, 2022.

(51) Int. Cl.
*F41A 19/10* (2006.01)
*F41A 17/46* (2006.01)

(52) U.S. Cl.
CPC ..... *F41A 19/10* (2013.01); *F41A 17/46* (2013.01)

(58) Field of Classification Search
CPC ..... F41A 17/46; F41A 19/10
See application file for complete search history.

(56) References Cited

U.S. PATENT DOCUMENTS

| | | | | |
|---|---|---|---|---|
| 1,389,944 | A * | 9/1921 | Garrison | F41A 17/36 89/137 |
| 5,560,134 | A * | 10/1996 | Van Niekerk | F41A 17/46 42/70.06 |
| 6,164,001 | A * | 12/2000 | Lee | F41A 19/17 42/69.01 |
| 9,970,724 | B1 * | 5/2018 | Acker | F41A 17/46 |
| 10,006,734 | B1 * | 6/2018 | Findlay | F41A 19/12 |
| 10,222,159 | B1 * | 3/2019 | Carr | F41A 17/46 |
| 11,274,894 | B1 * | 3/2022 | Hill | F41A 17/46 |
| 2003/0213159 | A1 * | 11/2003 | Cutini | F41A 17/46 42/70.06 |
| 2017/0059267 | A1 * | 3/2017 | Hudson, III | F41A 19/12 |
| 2018/0080731 | A1 * | 3/2018 | Hudson, III | F41A 19/10 |
| 2018/0094891 | A1 * | 4/2018 | Geissele | F41A 19/10 |
| 2020/0386502 | A1 * | 12/2020 | Niswander | F41A 19/10 |

FOREIGN PATENT DOCUMENTS

| | | | | |
|---|---|---|---|---|
| CN | 202582367 U | * | 12/2012 | F41A 17/02 |

* cited by examiner

*Primary Examiner* — Gabriel J. Klein
(74) *Attorney, Agent, or Firm* — Kim and Lahey Law Firm, LLC; Douglas W. Kim; Robert K. Merting

(57) ABSTRACT

A trigger assembly for providing a straight pull trigger may be provided. The trigger assembly may comprise a trigger shoe, a safety plunger, and a safety blade. The trigger shoe may comprise a trigger shoe cavity disposed between a trigger shoe first side and a trigger shoe second side. The trigger shoe may further comprise a safety plunger pocket. The safety plunger may be disposed in the safety plunger pocket. The safety blade may be slidably disposed in the trigger shoe cavity and be connected to the safety plunger. The safety plunger may retract into the trigger shoe from a safety plunger first position to a safety plunger second position when the safety blade slides in the trigger shoe from a safety blade first position to a safety blade second position.

16 Claims, 7 Drawing Sheets

STRAIGHT PULL TRIGGER

RELATED APPLICATION

Under provisions of 35 U.S.C. § 119(e), Applicant claims the benefit of U.S. Provisional Application No. 63/304,263 filed Jan. 28, 2022, the disclosure of which is incorporated herein by reference

BACKGROUND

A semi-automatic firearm may comprise a self-loading firearm whose action automatically cycles (i.e., ejects and rechambers) a new cartridge after each shot, but needs the operator to manually reset a hammer. The hammer needs to reset by relaxing the trigger before the next shot may be fired. Accordingly, only a single round may be discharged each time the trigger is depressed. In contrast, a fully-automatic (i.e., full-auto) firearm both cycles cartridges automatically and cycles (i.e., resets and releases) the hammer automatically as opposed to semi-auto firearms, which do only the former when the trigger is pulled. Consequently, for the duration of the trigger-pull, the full-auto rifle will fire multiple cartridges continuously until the full-auto firearm's magazine is depleted.

In firearms, a safety is a mechanism used to help prevent the accidental discharge of a firearm, helping to ensure safer handling. Safeties may generally be divided into subtypes such as internal safeties, which may not receive input from an operator, and external safeties, which may allow the operator to give input, for example, toggling a lever from "on" to "off". Sometimes these are called "passive" and "active" safeties respectively.

BRIEF DESCRIPTION OF THE FIGURES

The accompanying drawings, which are incorporated in and constitute a part of this disclosure, illustrate various embodiments of the present disclosure. In the drawings.

DETAILED DESCRIPTION

Overview

Figure 1A:
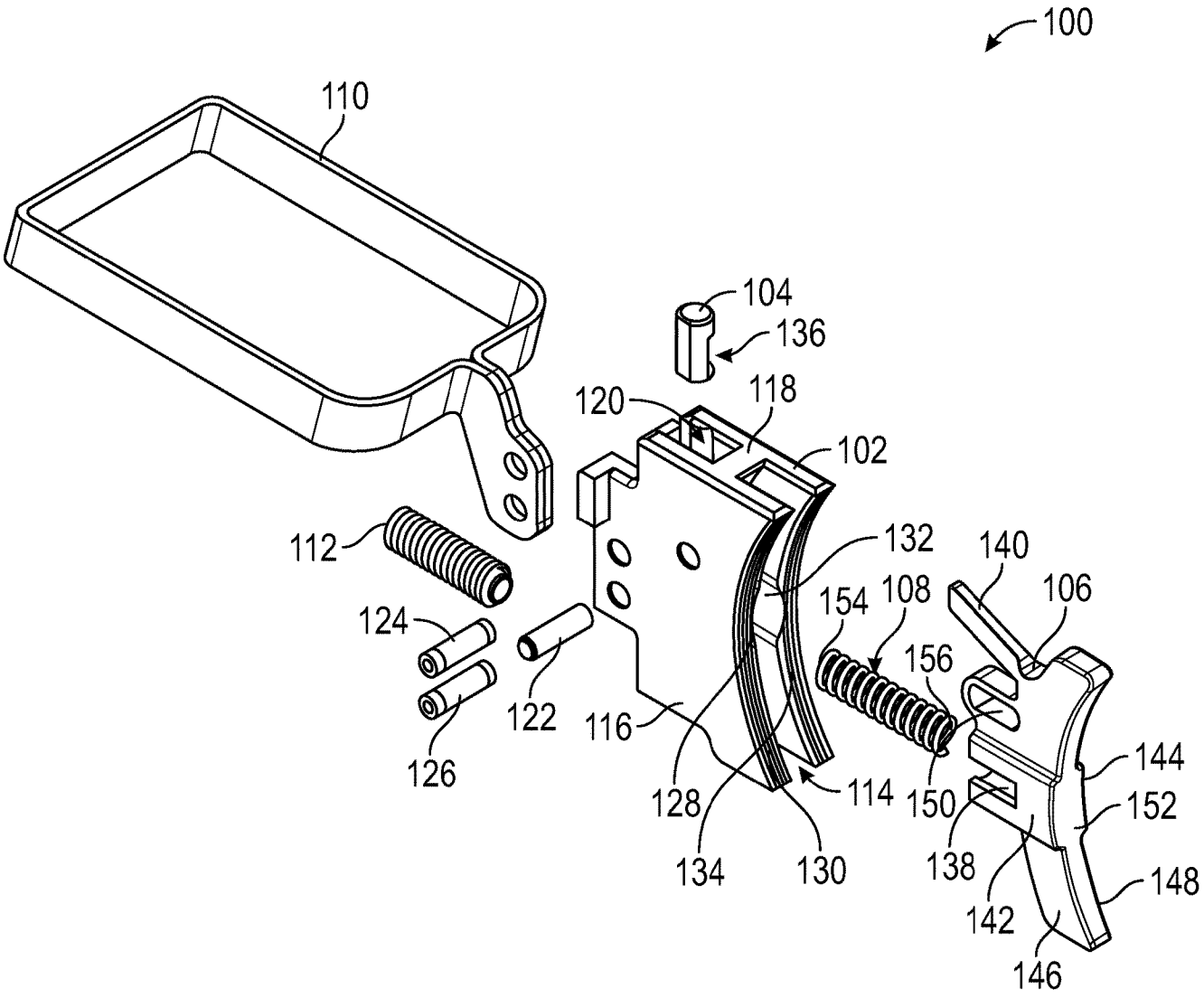
FIG. 1A shows an exploded view of a trigger assembly.

A trigger assembly for providing a straight pull trigger may be provided. The trigger assembly may comprise a trigger shoe, a safety plunger, and a safety blade. The trigger shoe may comprise a trigger shoe cavity disposed between a trigger shoe first side and a trigger shoe second side. The trigger shoe may further comprise a safety plunger pocket. The safety plunger may be disposed in the safety plunger pocket. The safety blade may be slidably disposed in the trigger shoe cavity and be connected to the safety plunger. The safety plunger may retract into the trigger shoe from a safety plunger first position to a safety plunger second position when the safety blade slides in the trigger shoe from a safety blade first position to a safety blade second position.

Both the foregoing overview and the following example embodiments are examples and explanatory only, and should not be considered to restrict the disclosure's scope, as described and claimed. Further, features and/or variations may be provided in addition to those set forth herein. For example, embodiments of the disclosure may be directed to various feature combinations and sub-combinations described in the example embodiments.

Example Embodiments

The following detailed description refers to the accompanying drawings. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

Some firearms may use a straight pull trigger with a bottom hinged safety blade. With this configuration, however, if the safety blade's front face is pressed close to the hinge, the safety may not be disengaged. Accordingly, embodiments of the disclosure may provide a straight pull trigger with a straight pull safety blade to solve the aforementioned problem and ensure retraction of the safety regardless of where the safety blade front face is pressed. There may be several benefits of using a straight pull trigger assembly consistent with embodiments of the disclosure. For example, the trigger safety and trigger shoe may both translate in the same direction, limiting trigger movement to translational movement, as opposed to translational and rotational. The translational movement of the straight pull safety blade may eliminate the risk of not disengaging the safety of a bottom hinged rotational safety blade.

FIG. 1A shows a trigger assembly 100 consistent with embodiments of the disclosure for providing a straight pull trigger. As shown in FIG. 1A, trigger assembly 100 may comprise a trigger shoe 102, a safety plunger 104, a safety blade 106, a compression device 108, a trigger stirrup 110, and an overtravel screw 112. Compression device 108 may comprise a spring. Trigger shoe 102 may comprise a trigger shoe cavity 114, a trigger shoe first side 116, a trigger shoe second side 118, a safety plunger pocket 120, a trigger shoe compression device pocket 202, a safety blade retaining pin 122, a first stirrup retaining pin 124, and a second stirrup retaining pin 126. Trigger shoe first side 116 may comprise a first trigger shoe slot 128 and a curved trigger shoe first side surface 130. Trigger shoe second side 118 may comprise a second trigger shoe slot 132 and a curved trigger shoe second side surface 134. Safety plunger 104 may comprise a safety plunger slot 136.

Figure 1B:
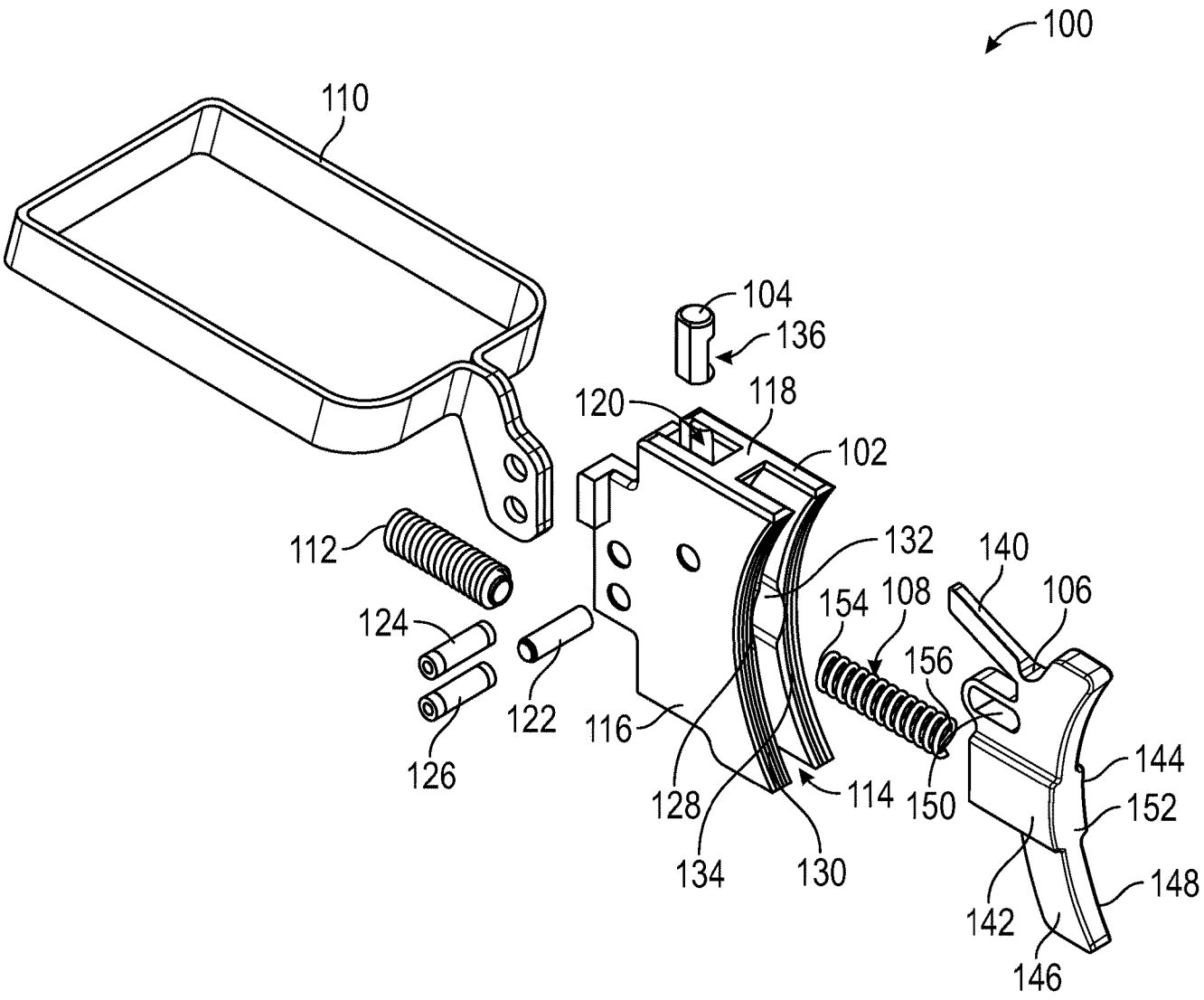
FIG. 1B shows an exploded view of a trigger assembly.

Safety blade 106 may comprise a safety blade compression device pocket 138, a safety blade arm 140, a first safety blade rail 142, a second safety blade rail 144, a safety blade first side 146, a safety blade second side 148, a safety blade retaining pin slot 150, and a curved safety blade surface 152. Compression device 108 may comprise a first end 154 and a second end 156. FIG. 1B shows trigger assembly 100 consistent with embodiments of the disclosure for providing a straight pull trigger. While safety blade compression device pocket 138 may be within the embodiment of FIG. 1B, its side made be enclose and not open as shown in FIG. 1A.

Figure 2A:
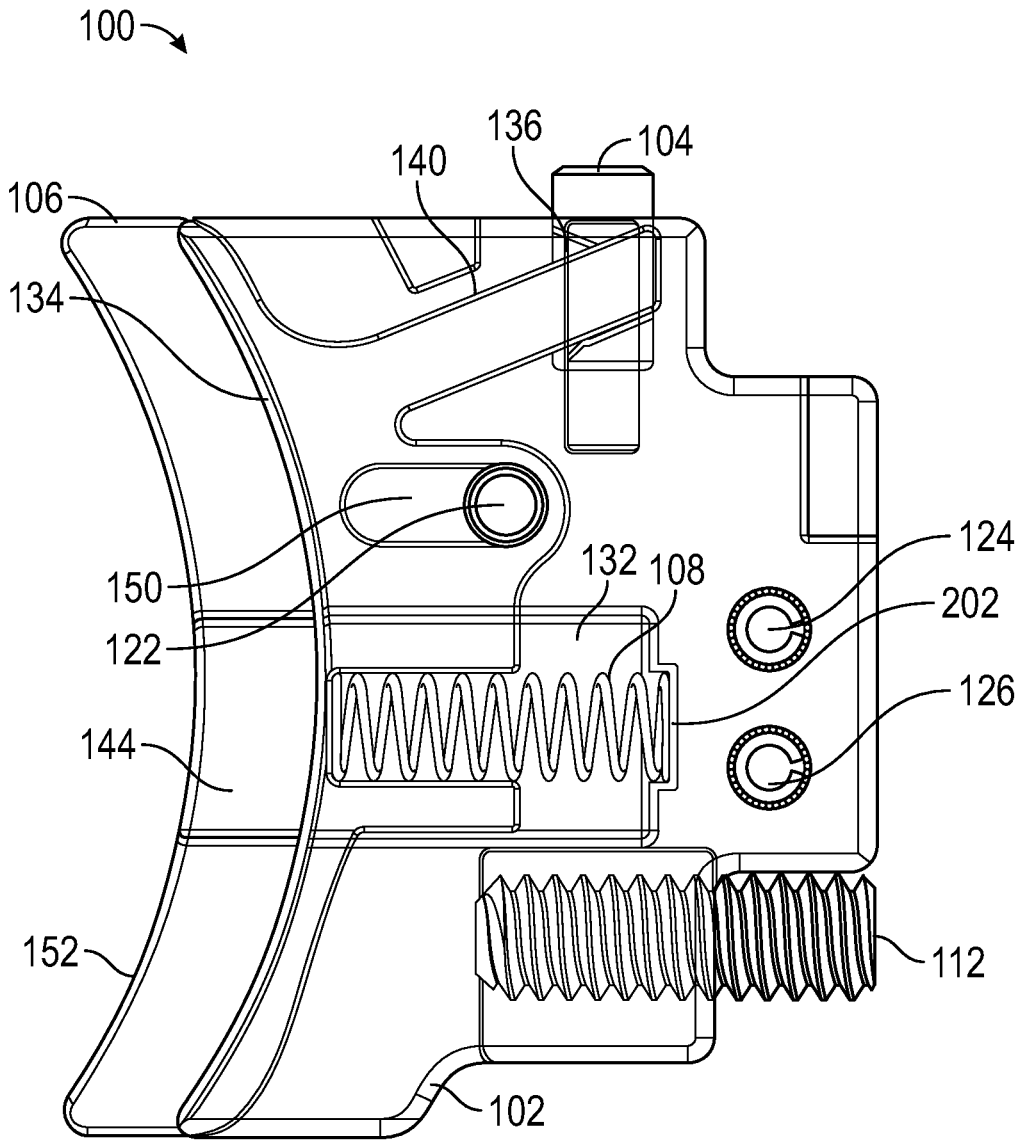
FIG. 2A shows a trigger assembly in a neutral position.
Figure 2B:
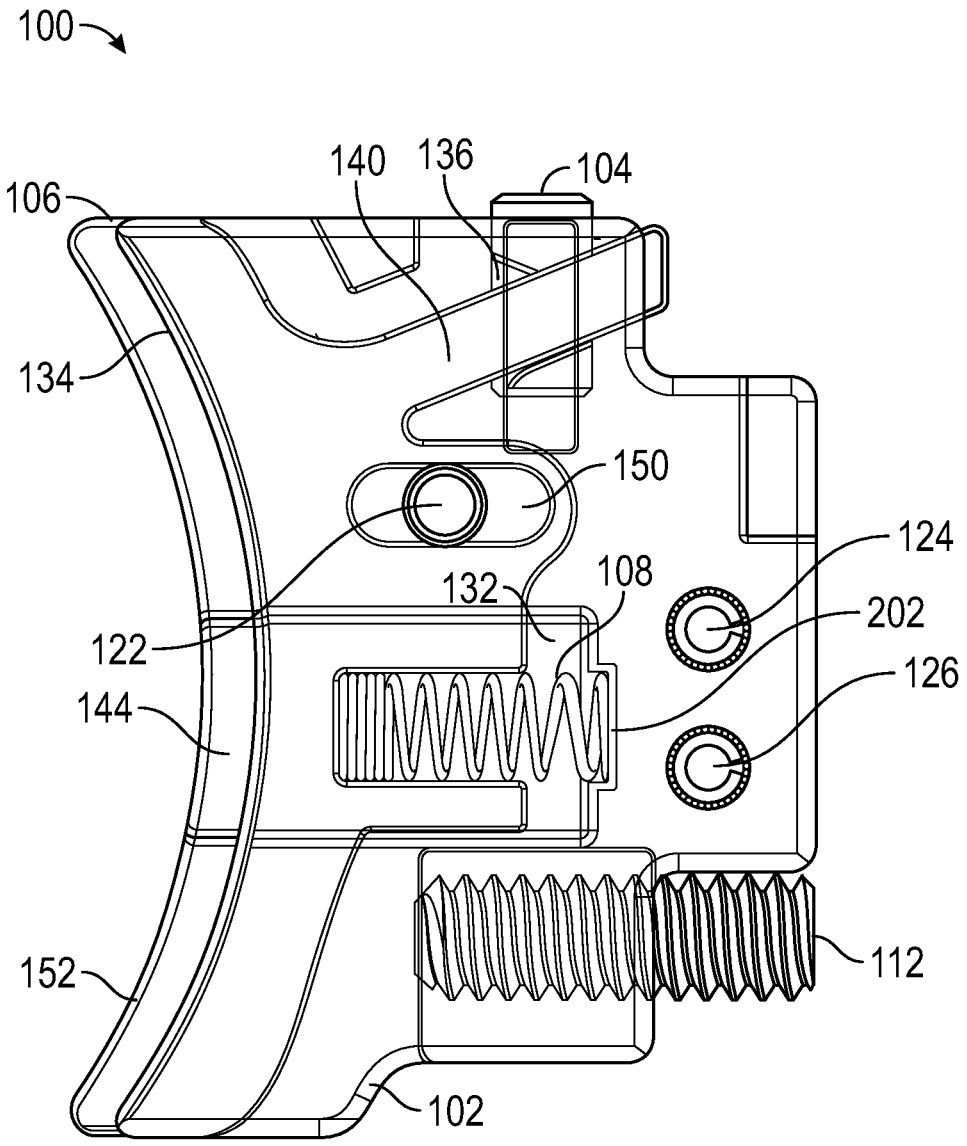
FIG. 2B shows a trigger assembly during safety disengagement.
Figure 2C:
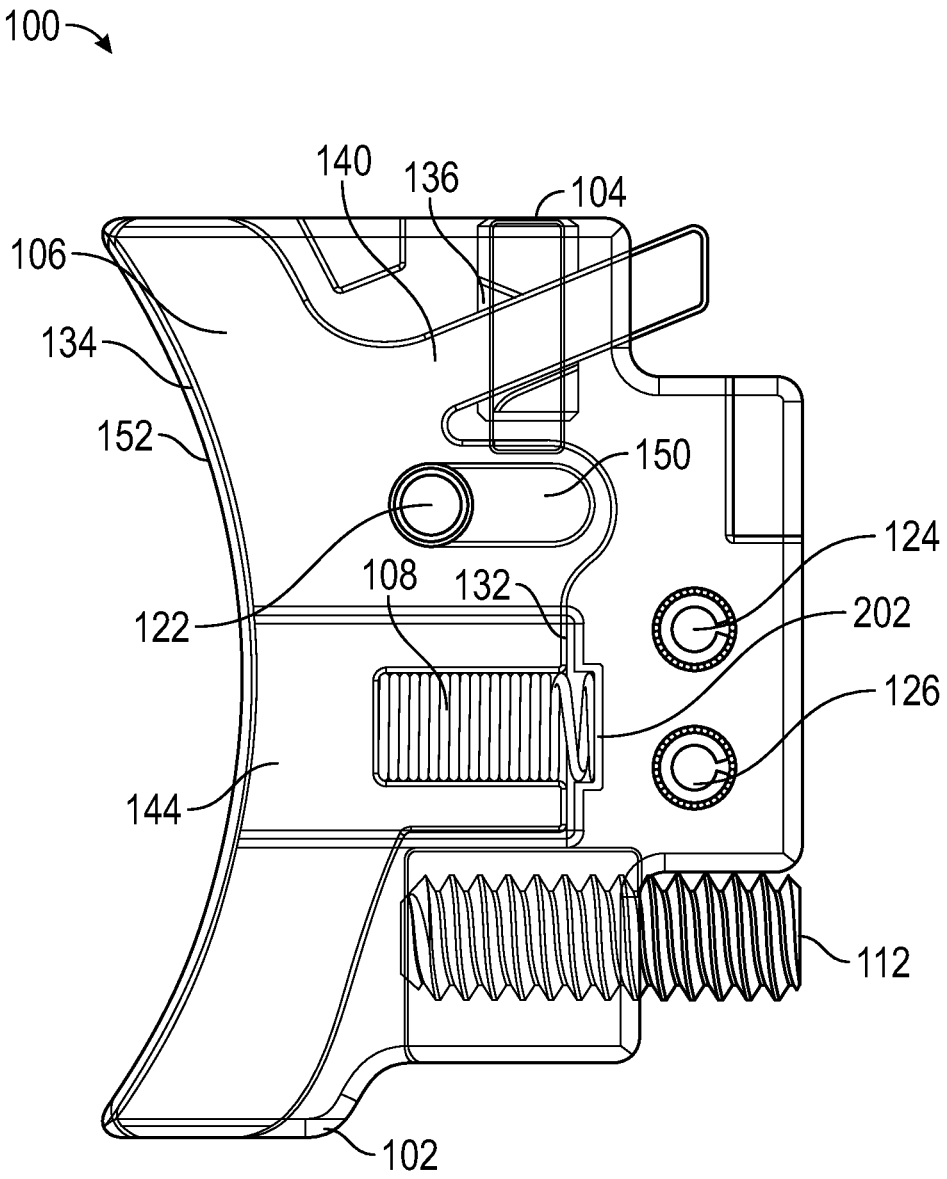
FIG. 2C shows a trigger assembly with a safety disengaged.
Figure 2D:
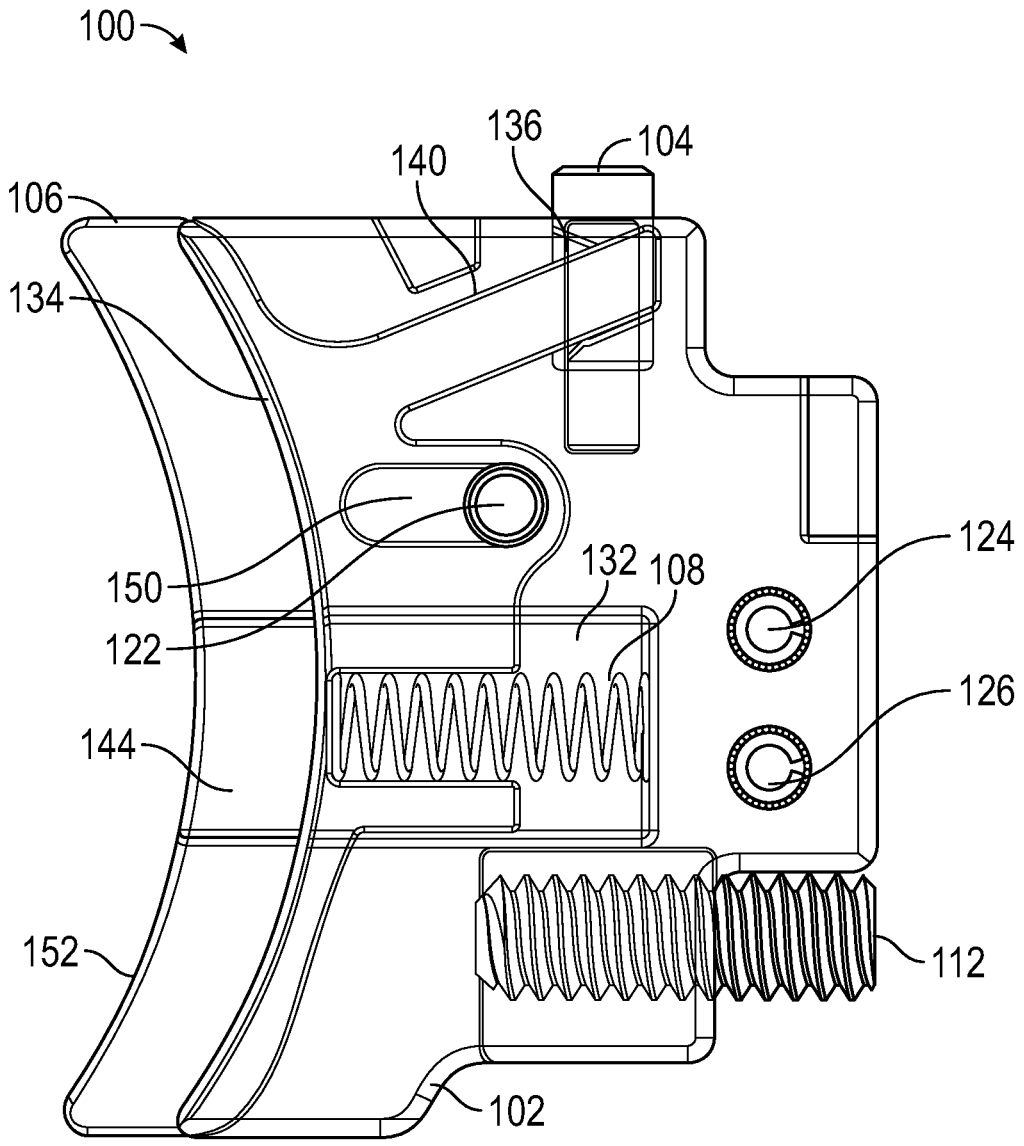
FIG. 2D shows a trigger assembly in a neutral position.
Figure 3:
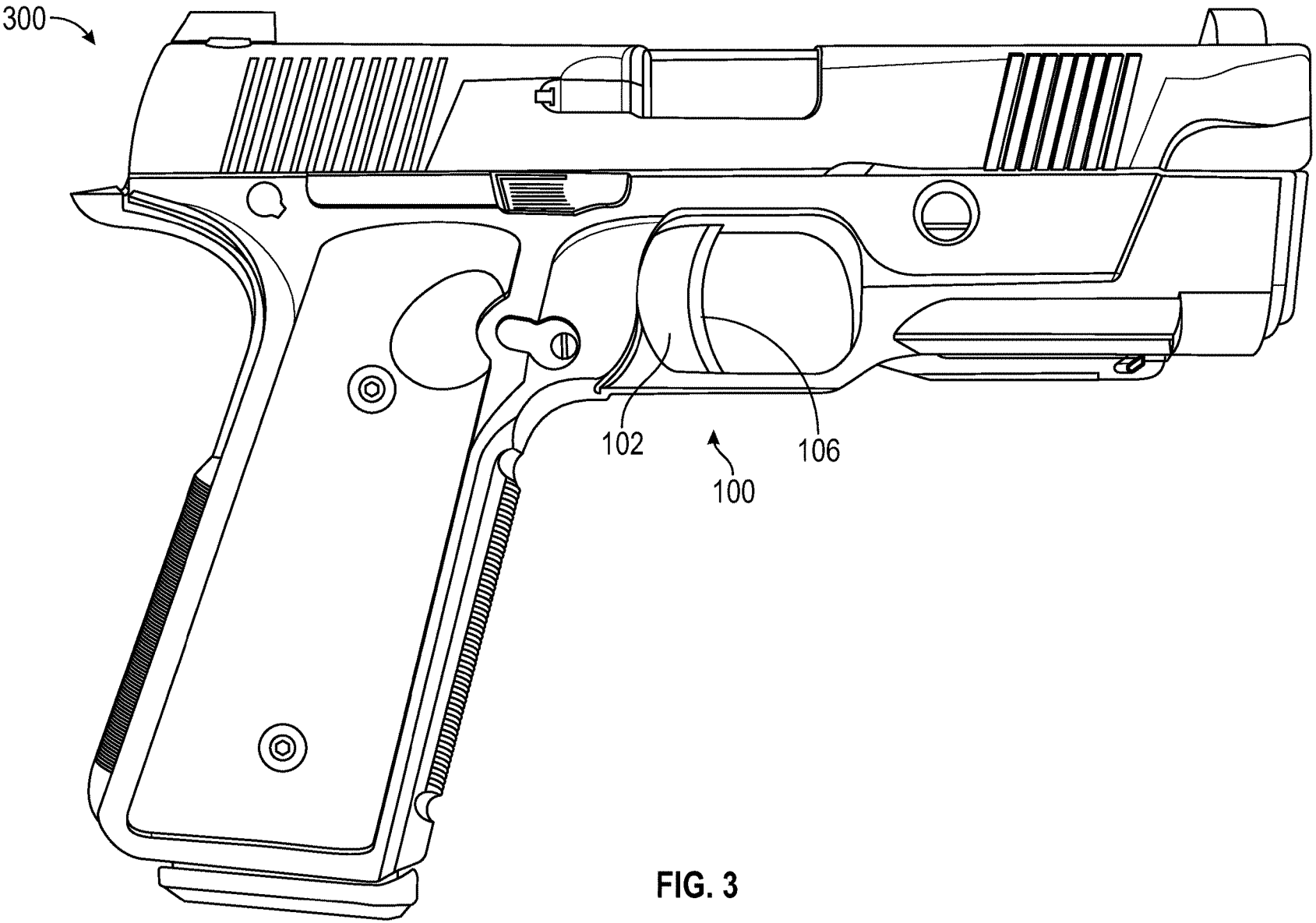
FIG. 3 shows a firearm that may utilize a trigger assembly.

FIG. 2A shows trigger assembly 100 in a neutral position, FIG. 2B shows trigger assembly 100 during safety disengagement, and FIG. 2C shows trigger assembly 100 with a safety disengaged. In other words, FIGS. 2A, 2B, and 2C illustrate trigger assembly 100's progression from safety engagement to safety disengagement. For example, FIG. 2A shows safety plunger 104 in a fully extended position. In this fully extended position, safety plunger 104 may extent into a safety frame pocket located in the frame of a firearm (e.g., a firearm 300 as illustrated by FIG. 3). While in this fully extended position, trigger shoe 102 may be in a locked position keeping trigger stirrup 110 stationary and thus inhibiting the firearm from discharging. FIG. 2D shows trigger assembly 100 in a neutral position with an embodiment where trigger shoe compression device pocket 202 may be omitted the compression device 108 may press against trigger shoe cavity 114.

As shown in FIG. 2B, safety blade 106 may be pulled or pressed by an operator of the firearm in a first direction toward trigger shoe 102. As safety blade 106 moves in this first direction, safety plunger 104 correspondingly retracts in a second direction into trigger shoe 102. The first direction may be perpendicular to the second direction.

FIG. 2C shows safety plunger 104 in a fully retracted position. In other words, safety plunger 104 may retract into trigger shoe 102 from a safety plunger first position to a safety plunger second position when safety blade 106 slides in trigger shoe 102 from a safety blade first position to a safety blade second position. Curved trigger shoe first side surface 130, curved trigger shoe second side surface 134, and curved safety blade surface 152 may be congruent when safety blade 106 is in the safety blade second position as shown in FIG. 2C.

In this fully retracted position, safety plunger 104 may no longer extent into the safety frame pocket located in the frame of the firearm. While in this fully retracted position, trigger shoe 102 may no longer be in a locked position and, if pulled further in the first direction, trigger stirrup 110 may cause the firearm to discharge. Accordingly, embodiments of the disclosure may provide a straight pull trigger with a straight pull safety blade (e.g., safety blade 106) to solve the aforementioned problem caused by hinged safety blades and ensure retraction of the safety regardless of where the safety blade front face (e.g., curved safety blade surface 152) is pressed.

Second end 156 of compression device 108 may nest in a receptacle (e.g., safety blade compression device pocket 138) in the back of safety blade 106 while first end 154 of compression device 108 may nests in a small pocket (e.g., a trigger shoe compression device pocket 202) cut into an internal face of trigger shoe 102. Other embodiments of the disclosure may omit trigger shoe compression device pocket 202. A cut-out mid-section (e.g., safety plunger slot 136) of safety plunger 104 may allow safety plunger 104 to connect onto safety blade arm 140 of safety blade 106. A vertical circular cut (e.g., safety plunger pocket 120) in trigger shoe 102 may allow for safety plunger 104 to translate vertically only. As safety blade 106 translates horizontally, safety plunger 104 may translate vertically due to an angled surface of safety blade arm 140 on which safety plunger 104 is secured.

Safety blade 106 may have horizontal rails (e.g., first safety blade rail 142 and second safety blade rail 144) protruding from each side (e.g., safety blade first side 146 and safety blade second side 148) respectively, which may fit into corresponding cuts (e.g., first trigger shoe slot 128 and second trigger shoe slot 132) in trigger shoe 102. These rails and cuts may allow for safety blade 106 to freely translate horizontally, but not vertically, and may not allow for rotation of safety blade 106.

Safety blade retaining pin 122 may be situated such that it fits into a slot (e.g., safety blade retaining pin slot 150) in safety blade 106. This pin and slot combination may prevent safety blade 106 from travelling too far forward or rearward in the horizontal direction.

Compression device 108 may push safety blade 106 horizontally forward. This position may result in safety plunger 104 being raised above a top of trigger shoe 102 and nesting in a pocket of a firearm's frame insert, preventing trigger shoe 102 from translating horizontally rearward in the firearm. In this way, the safety mechanism may be engaged. By pushing horizontally on the front face (e.g., curved safety blade surface 152) of safety blade 106, safety blade 106 may be pushed backward. This may compress compression device 108 and, as referenced above, retract safety plunger 104 from the pocket of the firearm's frame insert and allowing trigger shoe 102 to translate horizontally rearward in the firearm.

FIG. 3 shows a firearm 300 that may utilize trigger assembly 100. Accordingly, embodiments of the disclosure may provide a straight pull trigger for firearm 300 with a straight pull safety blade to solve the aforementioned problem and ensure retraction of the safety regardless of where the safety blade front face is pressed. There may be several benefits of using a straight pull trigger assembly consistent with embodiments of the disclosure. For example, the trigger safety and trigger shoe may both translate in the same direction, limiting trigger movement to translational movement, as opposed to translational and rotational. The translational movement of the straight pull safety blade may eliminate the risk of not disengaging the safety of a bottom hinged rotational safety blade.

Embodiments of the present disclosure, for example, are described above with reference to block diagrams and/or operational illustrations of methods and systems, according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

What is claimed is:

1. An apparatus comprising:

a trigger shoe having a trigger shoe cavity disposed between a trigger shoe first side and a trigger shoe second side wherein the trigger shoe further comprises a safety plunger pocket;

a safety plunger disposed in the safety plunger pocket; and a safety blade slidably disposed in the trigger shoe cavity and being connected to the safety plunger, wherein the safety plunger retracts into the trigger shoe from a safety plunger first position to a safety plunger second position when the safety blade slides in the trigger shoe from a safety blade first position to a safety blade second position, wherein the safety blade comprises a first safety blade rail on a first side of the safety blade that slidably engages a first trigger shoe slot disposed in an interior surface of the trigger shoe first side and wherein the safety blade comprises a second safety blade rail on a second side of the safety blade that slidably engages a second trigger shoe slot disposed in an interior surface of the trigger shoe second side, and wherein the safety blade being connected to the safety plunger comprises the safety blade comprising a safety blade arm that connects the safety blade to the safety plunger at a safety plunger slot disposed in the safety plunger.

2. The apparatus of claim 1, further comprising a compression device disposed between the safety blade and the trigger shoe.

3. The apparatus of claim 2, wherein the compression device compresses when the safety blade slides from the safety blade first position to the safety blade second position.

4. The apparatus of claim 2, wherein the compression device comprises spring.

5. The apparatus of claim 2, wherein the trigger shoe comprises a trigger shoe compression device pocket in which a first end of the compression device is disposed.

6. The apparatus of claim 2, wherein the safety blade comprises a safety blade compression device pocket in which a second end of the compression device is disposed.

7. The apparatus of claim 1, wherein an angled surface of the safety blade arm slidably engages the safety plunger slot to translate horizontal movement of the safety blade to vertical movement of the safety plunger.

8. The apparatus of claim 1, wherein the trigger shoe comprises a safety blade retaining pin disposed through a safety blade retaining pin slot disposed in the safety blade.

9. The apparatus of claim 1, wherein the safety blade slides in a first direction and the safety plunger slides in a second direction wherein the first direction is perpendicular to the second direction.

10. The apparatus of claim 1, wherein the trigger shoe first side comprises a curved trigger shoe first side surface, the trigger shoe second side comprises a curved trigger shoe second side surface, and the safety blade comprises a curved safety blade surface and wherein the curved trigger shoe first side surface, the curved trigger shoe second side surface, and the curved safety blade surface are congruent when the safety blade is in the safety blade second position.

11. An apparatus comprising:

a trigger shoe having a trigger shoe cavity disposed between a trigger shoe first side and a trigger shoe second side wherein the trigger shoe further comprises a safety plunger pocket, wherein the trigger shoe comprises a safety blade retaining pin disposed through a safety blade retaining pin slot disposed in the safety blade;

a safety plunger disposed in the safety plunger pocket;

a safety blade slidably disposed in the trigger shoe cavity and being connected to the safety plunger, wherein the safety plunger retracts into the trigger shoe from a safety plunger first position to a safety plunger second position when the safety blade slides in the trigger shoe from a safety blade first position to a safety blade second position; and a spring disposed between the safety blade and the trigger shoe wherein the spring compresses when the safety blade slides from the safety blade first position to the safety blade second position, wherein the trigger shoe comprises a trigger shoe spring pocket in which a first end of the spring is disposed and wherein the safety blade comprises a safety blade spring pocket in which a second end of the spring is disposed.

12. The apparatus of claim 11, wherein the safety blade comprises a first safety blade rail on a first side of the safety blade that slidably engages a first trigger shoe slot disposed in an interior surface of the trigger shoe first side and wherein the safety blade comprises a second safety blade rail on a second side of the safety blade that slidably engages a second trigger shoe slot disposed in an interior surface of the trigger shoe second side.

13. The apparatus of claim 11, wherein the trigger shoe first side comprises a curved trigger shoe first side surface, the trigger shoe second side comprises a curved trigger shoe second side surface, and the safety blade comprises a curved safety blade surface and wherein the curved trigger shoe first side surface, the curved trigger shoe second side surface, and the curved safety blade surface are congruent when the safety blade is in the safety blade second position.

14. An apparatus comprising:

a trigger shoe having a trigger shoe cavity disposed between a trigger shoe first side and a trigger shoe second side wherein the trigger shoe further comprises a safety plunger pocket;

a safety plunger disposed in the safety plunger pocket; and a safety blade slidably disposed in the trigger shoe cavity and being connected to the safety plunger, wherein the safety plunger retracts into the trigger shoe from a safety plunger first position to a safety plunger second position when the safety blade slides in the trigger shoe from a safety blade first position to a safety blade second position, wherein the safety blade being connected to the safety plunger comprises the safety blade comprising a safety blade arm that connects the safety blade to the safety plunger, wherein the safety blade arm is slidably disposed in a safety plunger slot disposed in the safety plunger, wherein the safety blade comprises a first safety blade rail on a first side of the safety blade that slidably engages a first trigger shoe slot disposed in an interior surface of the trigger shoe first side and wherein the safety blade comprises a second safety blade rail on a second side of the safety blade that slidably engages a second trigger shoe slot disposed in an interior surface of the trigger shoe second side.

15. The apparatus of claim 14, wherein the trigger shoe comprises a safety blade retaining pin disposed through a safety blade retaining pin slot disposed in the safety blade.

16. The apparatus of claim 14, wherein the safety blade slides in a first direction and the safety plunger slides in a second direction wherein the first direction is perpendicular to the second direction.

* * * * *